US011234540B2

(12) United States Patent
Savage

(10) Patent No.: US 11,234,540 B2
(45) Date of Patent: Feb. 1, 2022

(54) PUSH-PIN SECURING ASSEMBLY FOR BEDDING

(71) Applicant: Zavargê Pty Ltd, South Yarra (AU)

(72) Inventor: Shane Savage, South Yarra (AU)

(73) Assignee: ZaVargê Pty Ltd

( * ) Notice: Subject to any disclaimer, the term of this patent is extended or adjusted under 35 U.S.C. 154(b) by 0 days.

(21) Appl. No.: 16/629,012

(22) PCT Filed: Jul. 6, 2018

(86) PCT No.: PCT/AU2018/050703
§ 371 (c)(1),
(2) Date: Jan. 6, 2020

(87) PCT Pub. No.: WO2019/006515
PCT Pub. Date: Jan. 10, 2019

(65) Prior Publication Data

US 2020/0170425 A1 Jun. 4, 2020

(30) Foreign Application Priority Data

Jul. 7, 2017 (AU) ..... 2017902678

(51) Int. Cl.
*A47G 9/02* (2006.01)
*A44B 9/02* (2006.01)
*A44B 17/00* (2006.01)

(52) U.S. Cl.
CPC ..... *A47G 9/0261* (2013.01); *A44B 9/02* (2013.01); *A44B 17/0005* (2013.01); *A44B 17/0023* (2013.01); *A44B 17/0041* (2013.01); *A47G 9/0207* (2013.01); *A47G 2009/0269* (2013.01)

(58) Field of Classification Search
CPC ..... A44B 17/0005; A44B 17/0023; A44B 17/0041; A44B 9/02; A47G 2009/0269; A47G 9/0207; A47G 9/0261
See application file for complete search history.

(56) References Cited

U.S. PATENT DOCUMENTS 2,368,220 A * 1/1945 Hinds ..... A47G 9/086 5/413 R
3,083,378 A * 4/1963 Pursell ..... A47G 9/0238 5/498
4,520,518 A * 6/1985 Reaser ..... A47C 21/022 24/72.5

(Continued)

FOREIGN PATENT DOCUMENTS

| | | |
|---|---|---|
| CN | 203852126 | 10/2014 |
| GB | 2377376 | 1/2003 |
| WO | 2017008102 | 1/2017 |

*Primary Examiner* — David M Upchurch
(74) *Attorney, Agent, or Firm* — Krista A. Wittman

(57) ABSTRACT

A system for securing an internal padding element of a doona to conform with the extent of a sheath or cover of the doona; the system including providing fastening means at least proximate the respective four corners of the internal padding element and the sheath or cover of the doona; the fastening means comprising a first component and a second component arranged for releasable coupling one to the other; each first and second component provided with attachment means for securing respective components to the padding element and to the cover of the doona.

15 Claims, 7 Drawing Sheets

(56) References Cited

U.S. PATENT DOCUMENTS

| | | | | | |
|---|---|---|---|---|---|
| 4,782,543 | A * | 11/1988 | Hutton | A47C 21/022 | 24/72.5 |
| 4,796,317 | A * | 1/1989 | Kallman | A47G 9/0284 | 24/72.5 |
| 5,400,478 | A * | 3/1995 | Levinsohn | A47C 21/022 | 24/72.5 |
| 6,032,308 | A * | 3/2000 | Chuang | A47G 9/0261 | 5/413 AM |
| 7,111,345 | B1 * | 9/2006 | Hui | A47G 9/0207 | 5/501 |
| 10,098,485 | B2 * | 10/2018 | Hannula | A47G 9/0246 | |
| 2003/0074733 | A1 * | 4/2003 | Kelly | A47C 19/202 | 5/110 |
| 2004/0237197 | A1 * | 12/2004 | Cohen | A47G 9/0292 | 5/493 |
| 2005/0144721 | A1 * | 7/2005 | Linnane | A47G 9/0261 | 5/501 |
| 2010/0077576 | A1 * | 4/2010 | Dumouchel | A44B 9/02 | 24/707.4 |
| 2010/0275374 | A1 * | 11/2010 | Hipp | A47G 9/0246 | 5/496 |
| 2011/0314605 | A1 * | 12/2011 | Deguchi | A47G 9/0261 | 5/501 |
| 2017/0332801 | A1 * | 11/2017 | Gordon | A47C 21/02 | |
| 2018/0027998 | A1 * | 2/2018 | Heiman | A47G 9/0207 | |
| 2019/0298006 | A1 * | 10/2019 | Dagostino | A47G 9/0261 | |

* cited by examiner

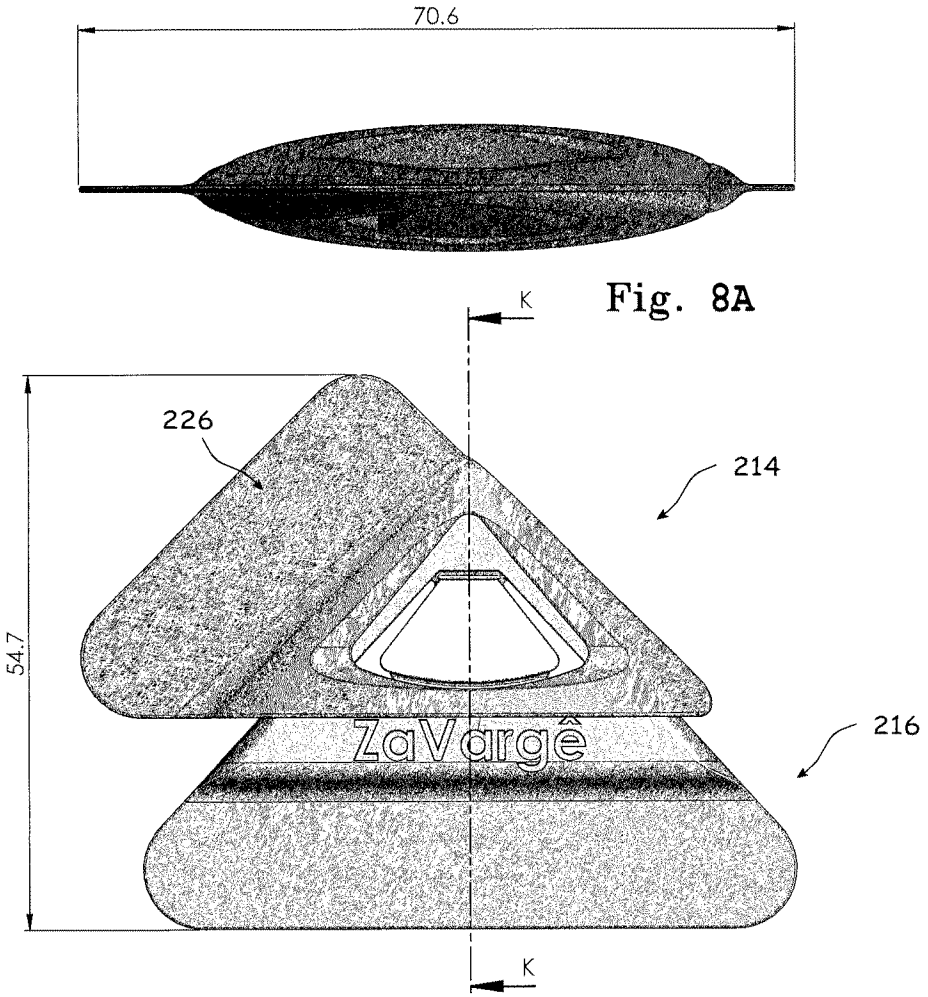
Fig. 8A
Fig. 8B
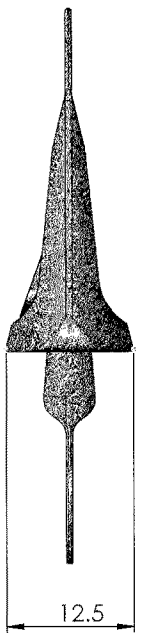
Fig. 8C
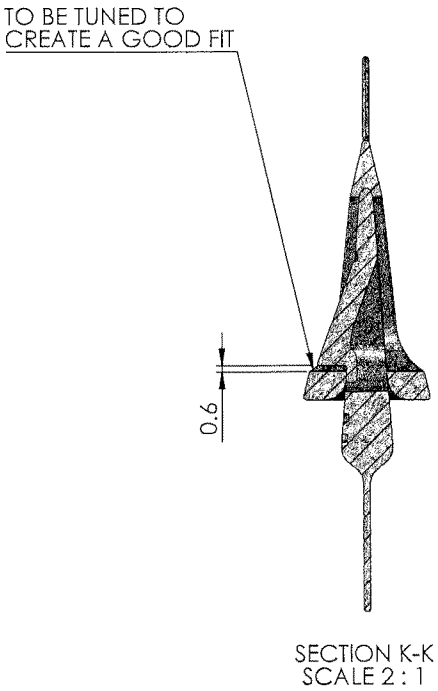
Fig. 8D

PUSH-PIN SECURING ASSEMBLY FOR BEDDING

CROSS-REFERENCE TO RELATED APPLICATIONS

This patent application is the U.S. National Phase patent application under 35 U.S.C. § 371, which claims priority to International Application No, PCT/AU2018/050703, filed on Jul. 6, 2018, which in turn claims the benefit of priority to Australian Patent Application No. AU 20170902678, filed on Jul. 7, 2017, the disclosures of which are incorporated by reference herein.

TECHNICAL FIELD

The present invention relates to bed clothes and, more particularly, to doona bed coverings.

BACKGROUND

Anyone who has slept under a typical doona, also known in the U.S. as a duvet, which includes an outer sheath with inner padding, will have experienced the annoying tendency for the inner padding to move within the sheath so that eventually the body of a user will only gain a partial or no benefit from the warmth which the inner padding was supposed to provide.

It is an object of the present invention to address or at least ameliorate some of the above disadvantages or provide a useful alternative.

Notes

The term "comprising" (and grammatical variations thereof) is used in this specification in the inclusive sense of "having" or "including", and not in the exclusive sense of "consisting only of".

The above discussion of the prior art in the Background of the invention, is not an admission that any information discussed therein is citable prior art or part of the common general knowledge of persons skilled in the art in any country.

SUMMARY OF INVENTION

Accordingly, in one broad form of the invention, there is provided a system for securing an internal padding element of a doona to conform with the extent of a sheath or cover of the doona; the system including providing fastening means at least proximate the respective four corners of the internal padding element and the sheath or cover of the doona.

Preferably, the sheath or cover comprises an upper layer and a lower layer of material; the upper layer of material sown to the lower layer of material at three edges of the generally rectangular sheath or cover.

Preferably, an upper layer of the internal padding is provided proximate at least at each corner with a first portion of a press stud.

Preferably, a second portion of each press stud is fixed in the upper layer of material of the internal padding.

Preferably, the upper layer of material of the sheath or cover of the doona is provided with slits proximate each of the four corners.

Preferably, buttons are attached to the upper layer of material of the sheath or cover beside each of the slits.

Preferably, the internal padding of the doona is provided with loops attached to an upper layer of material of the internal padding; the loops located to coincide with the location of the slits when the internal padding is located within the sheath or cover.

Preferably, in use, the loops are pulled through the corresponding slits and looped around the buttons to secure the internal padding relative the sheath or cover of the doona.

Preferably, the inner padding of the doona is provided with a pair of ribbons attached to an upper layer of material of the internal padding; the ribbons located to coincide with the location of the slits when the internal padding is located within the sheath or cover.

Preferably, in use the ribbons are pulled through the corresponding slits and tied around the buttons to secure the internal padding relative the sheath or cover of the doona.

Preferably, each internal corner of the doona cover is provided with a first component of the fastening means; corresponding corners of the internal padding provided with a second component of the fastening means.

Preferably, the first component is a female component formed as a right triangle body with an entry slot along a hypotenuse of the body; the entry slot providing access to a substantially triangular recess within the triangular body.

Preferably, at least one triangular surface of the body is provided with an opening communicating with the substantially triangular recess.

Preferably, the second component second comprises a main triangular portion; the second component provided with an tab extending from an hypotenuse of the triangular portion.

Preferably, the triangular portion of the second component is sized to enter the recess of the first component as a loose sliding fit.

Preferably, the second component is provided with at least one flexible tab; a rear end of the tab projecting above the surface of the triangular portion.

Preferably, the flexible tab is an integral part of the triangular portion; the flexible tab extending from the triangular portion at the leading end of the tab.

Preferably, the tab conforms in shape to an opening in the triangular portion with the flexible tab sloping upwardly from a region of attachment of the tab to the triangular portion, to a rearward edge of the tab.

Preferably, the tab conforms substantially in shape to the triangular opening in the surface of the first component.

Preferably, thickness of the triangular portion of the second component and the degree to which the flexible tab projects above its surface at the rear end of the tab are selected so that when the second component is inserted into the recess of the first component, the flexible tab is initially deflected into the opening in the triangular portion as it passes through the entry slot of the first component; the tab snapping back into its raised position within the triangular opening of the first component once the second component is fully inserted.

In another broad form of the invention, there is provided a method of securing an internal padding of a doona from movement within a sheath or cover of the doona; the method including the steps of:

providing a first form of attachment means at each corner of the sheath or cover, providing a second form of attachment means at each corresponding corner of the internal padding, securing respective first and second attachment means one to another at each of the corners.

Preferably, the first form of attachment means is an upper half of a press stud; the second form of attachment means being al lower half of the press stud.

Preferably, the first form of attachment means is a slit provided in an upper layer of material of the sheath or cover at each corner and a button attached to the upper layer of material beside each slit.

Preferably, the second form of attachment means is a loop attached to an upper layer of material of the internal padding to coincide with the location of the slits when the internal padding is located within the sheath or cover.

Preferably, the second form of attachment means is a pair of ribbons attached to an upper layer of material of the internal padding to coincide with the location of the slits when the internal padding is located within the sheath or cover.

Preferably, the first form of attachment means comprises a first component of a clip secured at each internal corner of the doona cover.

Preferably, the second form of attachment means comprises a second component of the clip secured at each corner of the internal padding.

Preferably, the second component is inserted into a recess provided in the first component; a flexible tab of the second component snapping back into a raised position to secure the second component within the recess of the first component.

BRIEF DESCRIPTION OF DRAWINGS

Embodiments of the present invention will now be described with reference to the accompanying drawings wherein:

FIG. 8A is an end view of a further embodiment of components for securing internal padding within a doona cover when assembled, FIG. 8B is a plan view of the assembled components of FIG. 8A, FIG. 8C is a side view of the assembled components of FIGS. 8A and 8B, FIG. 8D is a sectioned side view of the assembled components of FIGS. 8A to 8C.

DESCRIPTION OF EMBODIMENTS

Figure 1:
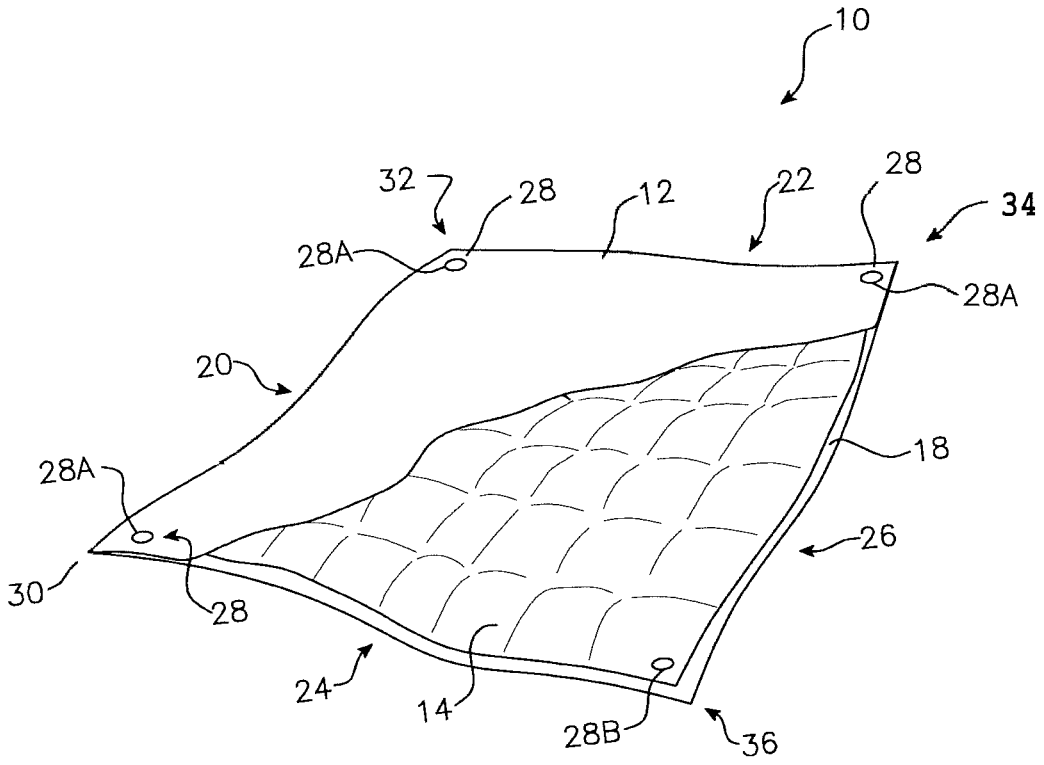
FIG. 1 shows a partially cut-away of a doona cover and internal padding and a first securing arrangement according to the invention.

With reference to FIG. 1, a typical doona 10 comprises a generally rectangular sheath 12 or envelope and a padded insert 14 sized to fit closely within the sheath 12. The sheath 12 is made up of an upper layer of material 16 and a lower layer of material 18. Typically also the upper layer of material 14 is sown to the lower level of material 18 around three edges, 20, 22 and 24 with the fourth edge 26 being left open so that the insert 14 may be removed as required for the washing of the sheath 12.

The insert 14 may be retained in the sheath 12 for use by, for example, a turned over flap (not shown) of the material along the edge 26 in the manner of a pillow slip. Thus in this arrangement, the insert 14 is free to move within the confines of the sheath 12.

In the present invention however, the padded insert 12 is restrained to maintain a position within the sheath 12 conforming to the limits of the internal edges of the sheath.

First Preferred Embodiment

In a first preferred arrangement, the sheath 12 and the padded insert 14 are provided with press studs 28, also known as fasteners, at least proximate the four corners 30, 32, 34 and 36 of the sheath and the corresponding corners of the padded insert 14. The female or upper halves 28A of the 26 press studs 28 are fixed into the upper layer of material 14 of the sheath 12, while the corresponding male or lower portions 28B are attached to the upper surface 38 of the padded insert 14.

Second Preferred Embodiment

Figure 2:
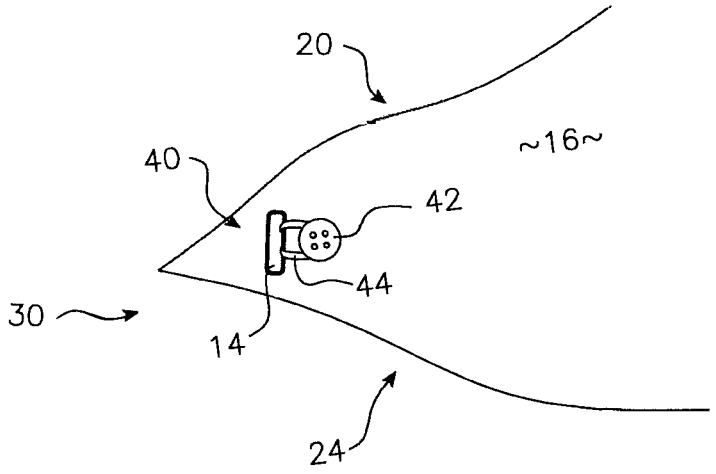
FIG. 2 shows an enlarged corner portion of the doona of FIG. 1 with a further arrangement for securing an internal padding to the doona cover.

In a second preferred arrangement as shown in FIG. 2, the upper layer of material 16 of the sheath 12 is provided with slits 40 adjacent the four corners of the sheath, and a button 42 attached beside each slit 40. The four corners of the padded insert 14 are provided with a pair of ribbons, or loops 44, which may be drawn through the slits 40 and, in the case of loops, fitted around the adjacent button 42, or in the case of ribbons, tied around the button, thus securing the padded insert 16 relative the sheath 12.

Third Preferred Embodiment

Figure 3:
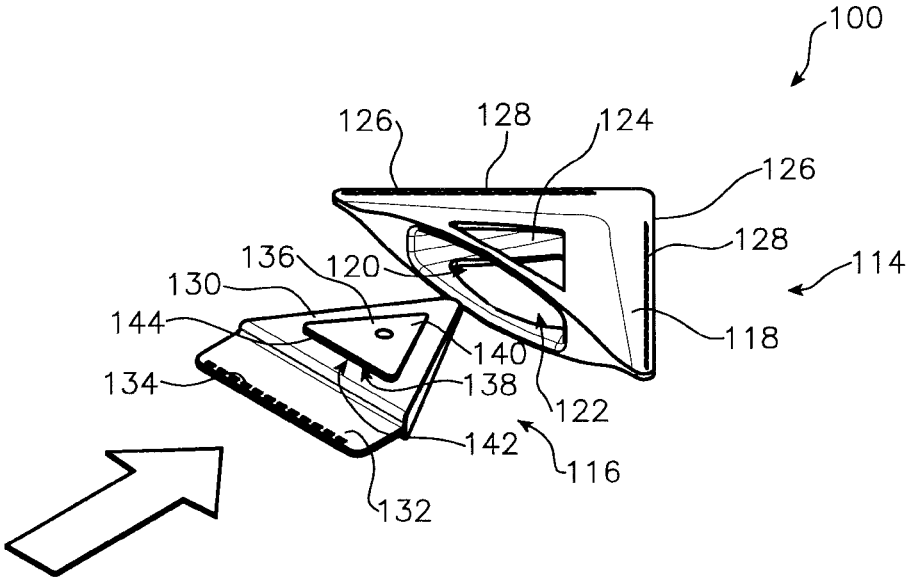
FIG. 3 is a perspective view of the components of a further embodiment of securing the internal padding within a doona cover.
Figure 4:
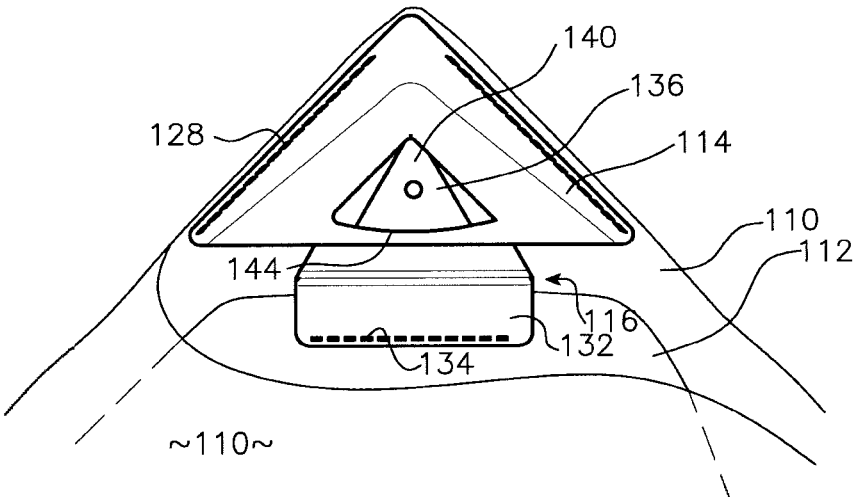
FIG. 4 is a perspective cutaway view of a corner of a doona cover with the components of the embodiment of FIG. 4 in use.
Figure 5:
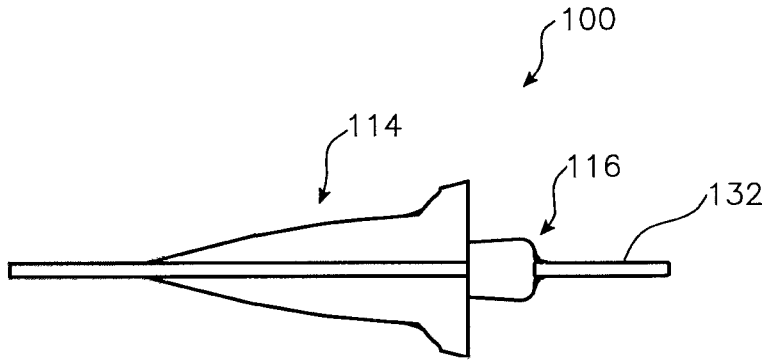
FIG. 5 is a side view of the two components of FIGS. 3 and 4 assembled in use.
Figure 6:
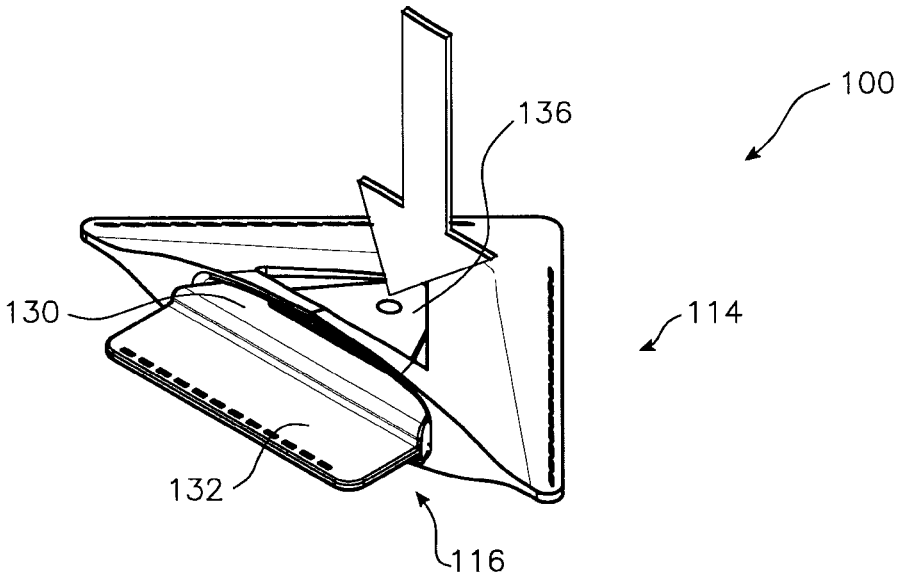
FIG. 6 is a perspective view of the assembled components indicating pressure to be applied for releasing one component from the other.
Figure 7:
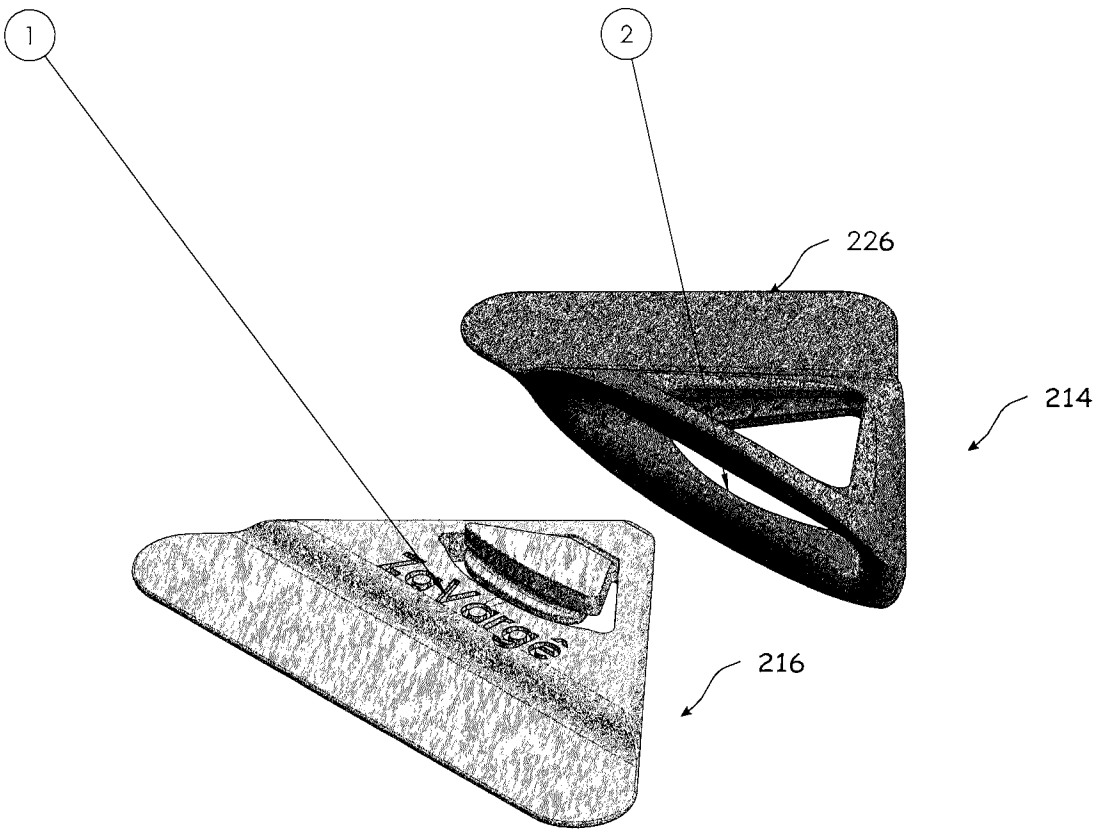
FIG. 7 is a perspective view of the components of FIG. 6, disassembled.

With reference now to FIGS. 3 to 6, in a further embodiment of the invention, a securing system for securing padding inside a doona cover includes the provision of clips 100 at the four corners of the cover 110 and the internal padding 112. As best seen in FIG. 3, each clip 100 comprises two components, a first component 114 which is secured within the doona cover 110 at each of the four corners (only one of which is shown), and a complementary second component 116 secured to the outside of the material of the padding 112 at its four corners. Preferably, both the first and the second components 114,116 are injection moulded from a suitable polymer.

Preferably, the first component 114 is a female component formed as a right triangle body 118 with an entry slot 120 along the hypotenuse of the body, providing access to a substantially triangular recess 122.

At least one triangular surface of the body 118 is provided with a preferably triangular opening 124 communicating with the triangular recess 122. The edges 126 of the sides of the body 118 opposite the hypotenuse may be provided with rows of apertures 128 for securing the body 118 into the internal corner of the doona cover 110 by sewing.

The second, male component 116, has a main portion 130 preferably of triangular shape and provided with an extending tab 132 at the hypotenuse of the triangular portion 130.

The tab 132 may be provided with a row or rows of apertures 134 for attaching the second component 116 at a corner of the internal padding 112 by sewing.

The triangular portion 130 of the second component 116 is sized to enter the recess 122 of the first component 114 as a loose sliding fit and is provided with at least one flexible tab 136 with a rear end 138 of the tab projecting above the surface of the triangular portion 130. The flexible tab 136 is an integral part of the triangular portion 130, extending from the triangular portion at the leading end 140 of the tab. In a most preferred form, the flexible tab 136 conforms in shape to an opening 142 in the triangular portion 130 with the flexible tab 136 sloping upwardly from its region of attachment at the leading end 140, to its rearward edge 144.

Furthermore, the shape of the flexible tab 136 conforms substantially to the triangular opening 124 in the surface of the first component 114 and which communicates with the recess 122 in that component.

The thickness of the triangular portion 130 of the second component 116 and the degree to which the flexible tab 136 projects above its surface at the rear end 138 of the tab are selected so that when the second component 116 is inserted into the recess 122 of the first component 114, the flexible tab 136 is initially deflected into the opening 142 in the triangular portion 130 as it passes through the entry slot 120 of the first component 114, but then snaps back into its raised position within the triangular opening 124 of the first component once the second component is fully inserted.

The rear edge 144 of the flexible tab 136 is then at a level relative the surface of the triangular body 118 of the first component 114 and is locked within the triangular opening 124.

Fourth Preferred Embodiment

In a further embodiment and in a variation of the above described third embodiment, with reference to FIGS. 8A to 8D, the securing system according to the invention, again comprises a first component 214 secured at each corner within the doona cover as described for the above embodiments, and a second component 216 secured to each corner of the padding.

In this embodiment however, the first component 214 is provided with a thin side tab 226 for securing the component at the adjoining seam of the doona cover when the component is inserted into a corner of the cover. The thin projection of the side tab 226 allows for an easier positioning of the component and requires a single pass only of stitching to secure the component in its required position.

Fifth Embodiment

Figure 12:
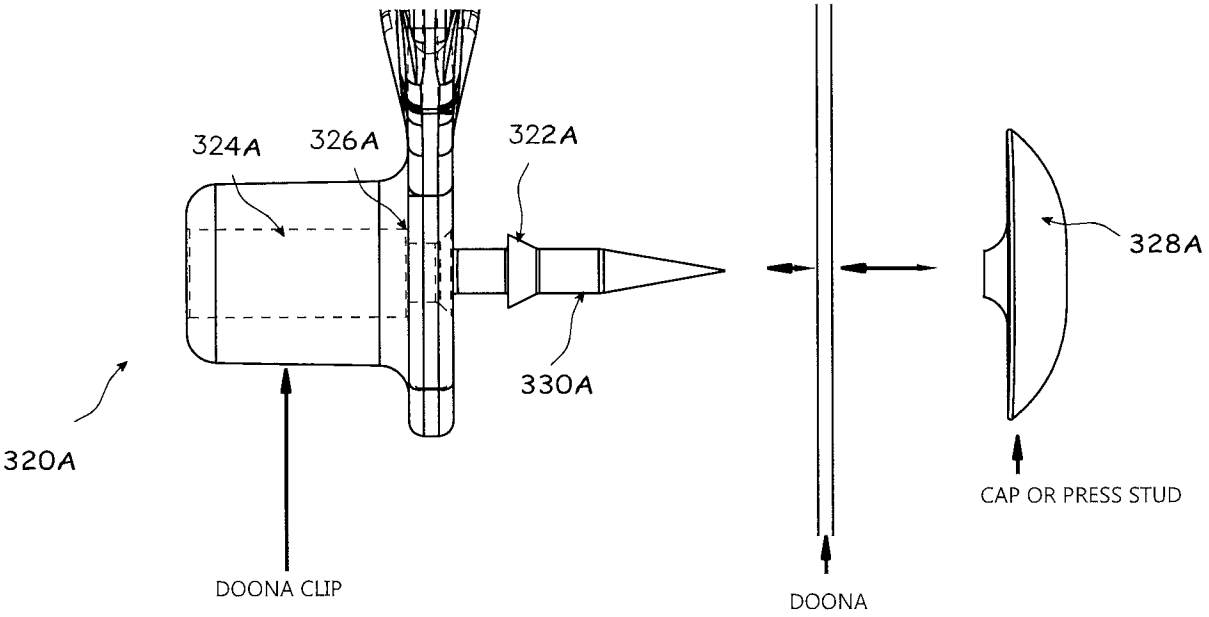
FIG. 12 is a side view, disassembled of a further embodiment components for securing internal padding within a doona dover when assembled.

FIG. 12 is a side view, disassembled of a further embodiment components for securing internal padding within a doona dover when assembled.

In this instance, like components are numbered as for the fourth embodiment except with postfixed A.

In this instance, the pin 330A is placed on the doona clip side of the assembly and interacts with a cap or press stud 328A located on the opposite side of the doona, as illustrated.

In some instances this arrangement may assist in better aligning the pin due to its improved visibility during an assembly operation.

In Use

Thus to secure padding within a doona cover with the securing system of this embodiment of the invention, each second component is inserted into the corresponding first component sufficient for the flexible tab to snap back into its raised position.

To disengage the second component 216 from the first component 214 for removal of the padding from the cover, the flexible tab 236 is depressed sufficient to allow the second component to be withdrawn from the recess 222.

Sixth Preferred Embodiment

Figure 9:
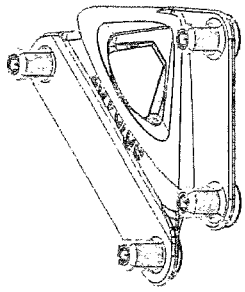
FIGS. 9, 10, 11 illustrate steps in assembly of the embodiment of FIGS. 8A, B, C, D.
Figure 9:
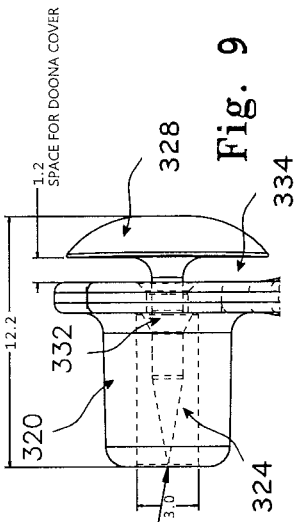
Figure 10:
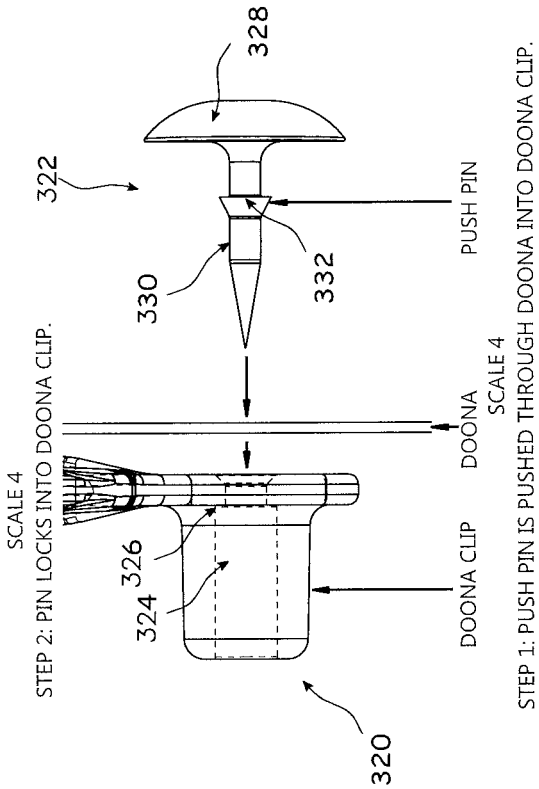
Figure 11:
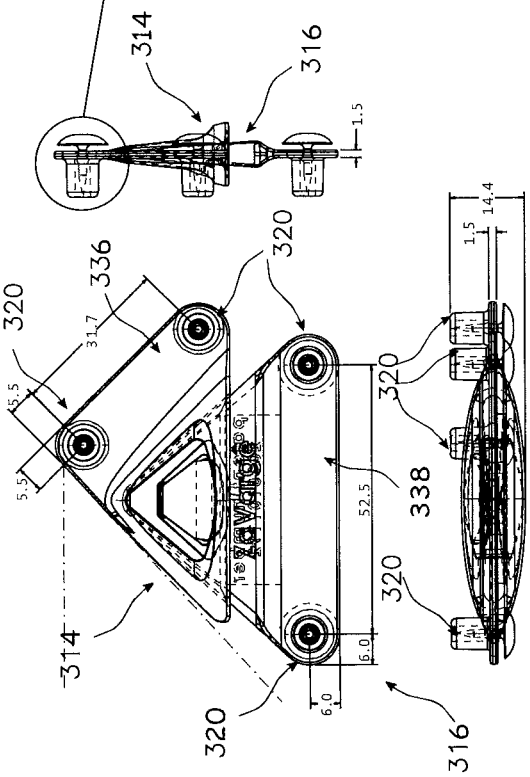

FIGS. 9, 10, 11 illustrate steps in assembly of the embodiment of FIGS. 8A, B, C, D.

In a further embodiment, the securing system again comprises a first component 314 and a second component 316 as previously described and previously shown (214,216) in FIG. 8B for releasable coupling one to the other. It will be noted that as in the previous embodiment of the component 214 shown in FIG. 8B, the triangular form in this embodiment also is extended to form a tab 336 along one edge of the first component 314 as shown in FIG. 11. Similarly, the second component 316 includes an extended tab 338 extending along the hypotenuse of the component.

In this embodiment, each of the components 314,316 is secured to the doona cover and to the padding respectively, by means of at least one, preferably a pair of mechanisms 318 as shown in FIGS. 9 and 10.

With reference to FIG. 9, the mechanism 318 comprises a socket 320 and a push pin 322. The socket 320 includes a central aperture 324 formed with a narrowing restriction 326. The push pin 322 comprises a head 328 and a shank 330 with the shank 330 provided with a tapered projection 332. The restriction 326 and the tapered projection 332, are so sized as to allow the shank 330 and the tapered projection 332 to be inserted into the aperture 324 with the projection 332 passing through the restriction as a snap fit, thus securing the push pin 322 in the socket 320 as shown in FIG. 10.

The location of the restriction 326 in the socket 320, and the location of the tapered projection 332 on the shank of the push pin 322, are such as to leave a gap 334 sufficient to accommodate the material of the doona or the padding.

Turning now to FIG. 11, each of the first component 314 and the second component 316 are preferably provided with two of the sockets 320 integrally formed in the tabs 336 and 338 of the first and second components respectively. In Use Thus to secure either the first component 314 to the doona cover, or the second component 316 to the padding within the cover in this fifth embodiment, push pins 322 are pushed through the material of cover or padding at the required separation, and then pushed into the sockets 320.

A similar assembly operation can be performed utilizing the arrangement of FIG. 12. As previously stated, the pin will be visible from the doona clip side which may assist in alignment of the pin through the doona.

INDUSTRIAL APPLICABILITY

The present invention provides a solution to the problem of the loose internal padding of a doona from moving with the outer sheath or cover of the doona, thereby reducing its effectiveness in properly insulating a user from cold.

The invention claimed is:

1. A system for securing an internal padding element of a doona comprising:

a plurality of fastening means each positioned at least proximate to one of four corners of an internal padding element and a cover of a doona, each of the fastening means comprising:

a first component and a second component arranged for releasable coupling, each of the first component and second component respectively attached to an interior of the cover and the internal padding of the doona, wherein the first component is a female component formed as a triangular body with an entry slot and the second component is formed with a main triangular portion sized to enter the entry slot and engage with a recess in the triangular body of the first component and the main triangular portion is provided with a tab extending from an hypotenuse of the main triangular portion.

2. The system of claim 1, wherein the cover of the doona comprises an upper layer and a lower layer of material; the upper layer of material sown to the lower layer of material at three edges of the generally rectangular cover.

3. The system of claim 1, wherein each internal corner of the doona cover is provided with the first component of the fastening means; corresponding corners of the internal padding provided with the second component of the fastening means.

4. The system of claim 1, wherein the entry slot provides access to the recess within the triangular body.

5. The system of claim 4, wherein at least one triangular surface of the triangular body is provided with an opening communicating with the substantially triangular recess.

6. The system of claim 1, wherein the main triangular portion of the second component is sized to enter the recess of the first component as a loose sliding fit.

7. The system of claim 1, wherein the second component is provided with at least one flexible tab; a rear end of the tab projecting above the surface of the triangular portion.

8. The system of claim 7, wherein the flexible tab is an integral part of the triangular portion; the flexible tab extending from the triangular portion at the leading end of the tab.

9. The system of claim 7, wherein the flexible tab conforms in shape to the opening in the triangular surface of the body of the first component; the flexible tab sloping upwardly from a region of attachment of the flexible tab to the triangular portion, to a rearward edge of the flexible tab.

10. The system of claim 7, wherein the flexible tab conforms substantially in shape to the triangular opening in the surface of the first component.

11. The system of claim 7, wherein thickness of the triangular portion of the second component and the degree to which the flexible tab projects above its surface at the rear end of the flexible tab are selected so that when the second component is inserted into the recess of the first component, the flexible tab is initially deflected into the opening in the triangular portion as it passes through the entry slot of the first component; the flexible tab snapping back into its raised position within the triangular opening of the first component once the second component is fully inserted.

12. A method of securing an internal padding of a doona comprising the steps of:

providing a first component of attachment means at each corner inside a cover of a doona;

providing a second component of attachment means at each corresponding corner of an internal padding positioned within an interior of the doona; and securing respective first and second components of the attachment means one to another at each of the corners;

wherein each of the first and second components of attachment means are formed as a right angled triangular body and a flexible tab formed on the second component engages with an opening in the right angled triangular body of the first component.

13. The method of claim 12, wherein the first component of attachment means comprises a first component of a clip secured at each internal corner of the doona cover.

14. The method of claim 12, wherein the second component of attachment means comprises a second component of the clip secured at each corner of the internal padding.

15. The method of claim 14, wherein the flexible tab of the second component snaps into a raised position to secure the second component within the opening in the right angled triangular body of the first component.

* * * * *